US006745819B2

(12) United States Patent
Kamm et al.

(10) Patent No.: US 6,745,819 B2
(45) Date of Patent: Jun. 8, 2004

(54) VERTICAL DIE CASTING PRESS AND METHOD OF PRODUCING DIE CAST METAL PARTS

(75) Inventors: Richard J. Kamm, Vandalia, OH (US); Michael J. Loughman, Tipp City, OH (US); Ronald P. Swarts, Dayton, OH (US)

(73) Assignee: THT Presses Inc., Dayton, OH (US)

( * ) Notice: Subject to any disclaimer, the term of this patent is extended or adjusted under 35 U.S.C. 154(b) by 0 days.

(21) Appl. No.: 10/274,688

(22) Filed: Oct. 21, 2002

(65) Prior Publication Data

US 2003/0037901 A1 Feb. 27, 2003

Related U.S. Application Data

(63) Continuation-in-part of application No. 09/860,088, filed on May 17, 2001, now Pat. No. 6,467,528.

(51) Int. Cl.[7] ..... B22D 17/00; B22D 19/00; B22D 37/00

(52) U.S. Cl. ..... 164/113; 164/98; 164/312; 164/133; 164/137

(58) Field of Search ..... 164/113, 98, 312, 164/133, 137

(56) References Cited

U.S. PATENT DOCUMENTS 3,866,666 A 2/1975 Wunder
4,799,534 A 1/1989 Uemo et al.
4,871,010 A * 10/1989 Dannoura ..... 164/253
5,263,531 A 11/1993 Drury et al.
5,332,026 A 7/1994 Thieman et al.
5,660,223 A 8/1997 Thieman et al.
5,954,116 A 9/1999 Jung
6,467,528 B1 * 10/2002 Kamm et al. ..... 164/113

* cited by examiner

*Primary Examiner*—Kiley Stoner
*Assistant Examiner*—I.-H. Lin
(74) *Attorney, Agent, or Firm*—Jacox, Meckstroth & Jenkins

(57) ABSTRACT

A fiber reinforced porous preform is positioned within a die cavity defined by upper and lower die members, and the lower die member defines at least one gate opening in the center portion of a water cooled shot sleeve which receives a vertically moveable shot piston. The area of the gate opening is small relative to the area of the shot sleeve, and the lower die member defines an annular recess above the inner surface of the shot sleeve for entrapping a shell of pre-solidified metal. Air vent slots extend outwardly between the shot sleeve and lower die member and are closed by the shell of pre-solidified metal. In one embodiment, the shot sleeve and shot piston are non-circular or oval in cross-section; and the lower die member has a plurality of longitudinally space gate openings.

8 Claims, 3 Drawing Sheets

VERTICAL DIE CASTING PRESS AND METHOD OF PRODUCING DIE CAST METAL PARTS

Cross-Reference to Related application

This application is a CIP of Ser. No. 09/860,088, filed on May 17, 2001 and now issued as U.S. Pat. No. 6,467,528.

BACKGROUND OF THE INVENTION

The present invention relates to a vertical die casting press of the type disclosed in U.S. Pat. Nos. 5,332,026 and 5,660,223 which issued to the assignee of the present invention, and to other forms of vertical die casting presses or apparatus, such as disclosed in U.S. Pat. Nos. 3,866,666 and 4,799,534. In such a press or apparatus, a frame supports one or more vertical shot cylinders or sleeves, and each sleeve receives a shot piston mounted on a shot piston rod connected to a hydraulic cylinder. The shot sleeve receives a molten die casting metal which is forced upwardly by the shot piston into a die cavity defined between a vertically moveable upper die member and a lower plate or die member. The lower die member defines a gate opening through which the metal within the shot sleeve is forced upwardly into the die cavity to form a die cast part. As shown in the above '026 patent, after the molten metal has cooled within the die cavity, the upper die member is unclamped and elevated, and the lower die member is shifted laterally or horizontally to a station where the part is removed from the lower die member. The remaining solidified metal or biscuit within the shot sleeve is removed by elevating the shot piston and pressing the biscuit laterally from the shot piston. When multiple shot sleeves are used in the press, the shot sleeves are indexed between a metal receiving station and a metal injection or transfer station, for example, as disclosed in above '223 patent.

It has been determined that a vertical die casting press may be constructed and used for efficiently and effectively producing an elongated metal part or a high quality fiber reinforced metal part, such as an aluminum or magnesium part having high strength and stiffness where desired, and also a high strength/weight ratio. For example, a C-shaped brake caliper housing for a motor vehicle is commonly produced from cast iron in order to obtain the necessary strength. However, with a die casting press constructed and used in accordance with the present invention, a high quality die cast fiber reinforced aluminum brake caliper housing may be efficiently produced with the necessary strength and stiffness and with the important advantage of a significant reduction in weight. Other high quality fiber reinforced aluminum and magnesium parts and elongated parts may also be efficiently produced with the apparatus and method of the invention.

SUMMARY OF THE INVENTION

The present invention is directed to an improved vertical die casting apparatus or press and a method of die casting light weight metal parts, and which is ideally suited for die casting fiber reinforced aluminum and magnesium parts having a high strength/weight ratio and a high stiffness. The press and method of the invention is also effective to produce elongated metal parts and light weight metal parts without the inclusion of solid metal particles and with effective infiltration of porous and fibrous reinforcing preforms within the part.

In accordance with one embodiment of the invention, a vertical die casting press includes a water cooled shot sleeve which receives a vertically moveable water cooled shot piston connected by a piston rod to a hydraulic cylinder. The shot sleeve and shot piston define a shot chamber under a lower gate plate or die member which cooperates with a vertically moveable upper die member to define a die cavity corresponding to the part to be die cast. In one embodiment, the lower gate plate or die member defines a gate opening within a center portion of the shot chamber, and the diameter of the shot sleeve is at least three times the width or diameter of the gate opening, and preferably greater. The lower die member also defines an annular metal entrapment cavity or recess aligned with the inner surface of the shot sleeve, and relatively deep air vent slots extend laterally outwardly from the entrapment recess within the lower mold die member. In another embodiment, the shot sleeve and piston are non-cylindrical or oval, and the lower die member defines a plurality of longitudinally spaced gate openings within a center portion of the shot chamber.

A vertical die casting press of the invention is ideally suited for die casting elongated parts or fiber reinforced aluminum and magnesium parts, and the reinforcing fibers are positioned within the die cavity by a porous preform located within the die cavity where high tensile strength and stiffness is required in the die cast part. After molten metal, such as aluminum or magnesium, is poured or inserted into the shot chamber, and the upper and lower die members are positioned and clamped above the shot sleeve, the molten metal is forced upwardly by the shot piston through the center gate opening and into the die cavity. As the shot piston moves upwardly within the shot sleeve, the pre-solidified metal shell adjacent the shot sleeve collapses, and the upper portion of the shell is forced into the entrapment recess. The displaced air above the molten metal within the shot sleeve flows outwardly through the radial vent slots which are then closed by the collapsing shell of pre-solidified metal. Thus only the highest quality molten metal from the center portion of the shot chamber flows upwardly through the gate opening or openings into the die cavity to infiltrate a porous preform with the reinforcing fibers.

Other features and advantages of the invention will be apparent from the following description, the accompanying drawings and the appended claims.

DESCRIPTION OF THE PREFERRED EMBODIMENTS

Figure 1:
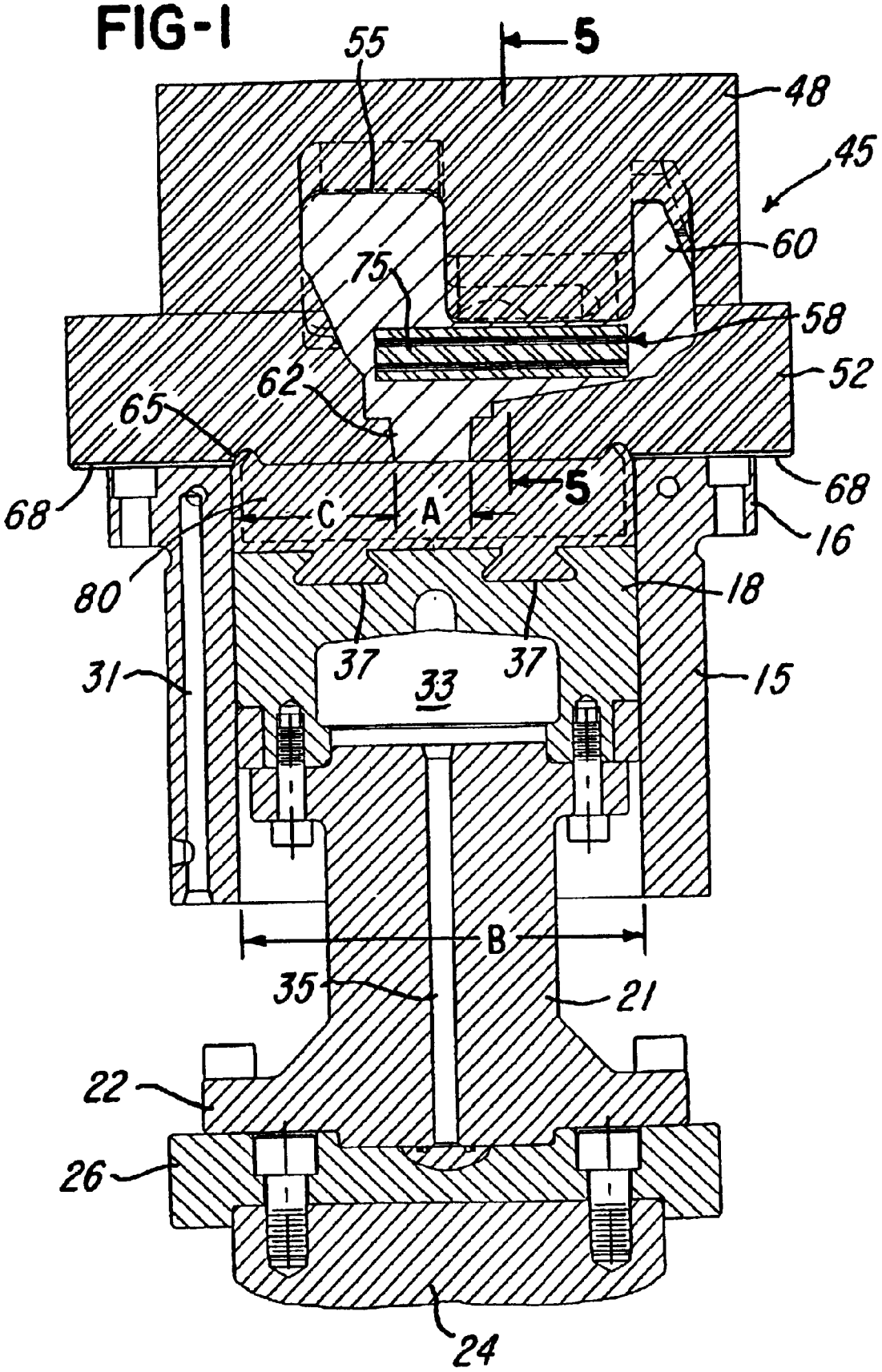
FIG. 1 is a vertical and axial section through the primary components of a vertical die casting press and through a set of upper and lower die members constructed in accordance with the invention.

FIG. 1 illustrates components of a vertical die casting press of the type disclosed in above-mentioned U.S. Pat.

Nos. 5,332,026 and 5,660,223, the disclosures of which are incorporated by reference. In the press, a cylindrical shot sleeve 15 includes an upper flange 16 which is adapted to be secured to a rotary indexing table as shown in the '223 patent. The shot sleeve 15 receives a vertically moveable shot piston 18 which is mounted on a piston rod 21 having a bottom flange 22 releasably coupled to a piston rod 24 of a hydraulic shot cylinder by a coupling plate 26, as disclosed in the above '223 Patent. The shot sleeve 15 is provided with circumferentially spaced and axially extending water cooling passages 31 for maintaining the shot sleeve within a predetermined temperature range, and the shot piston 18 has a water cooling chamber 33 which receives cooling water through axially extending passages 35 within the shot piston rod 21. A pair of parallel spaced and tapered dovetail slots 37 are formed within the top and surface of the shot piston 18, in the same manner as disclosed in the above '223 patent.

Figure 2:
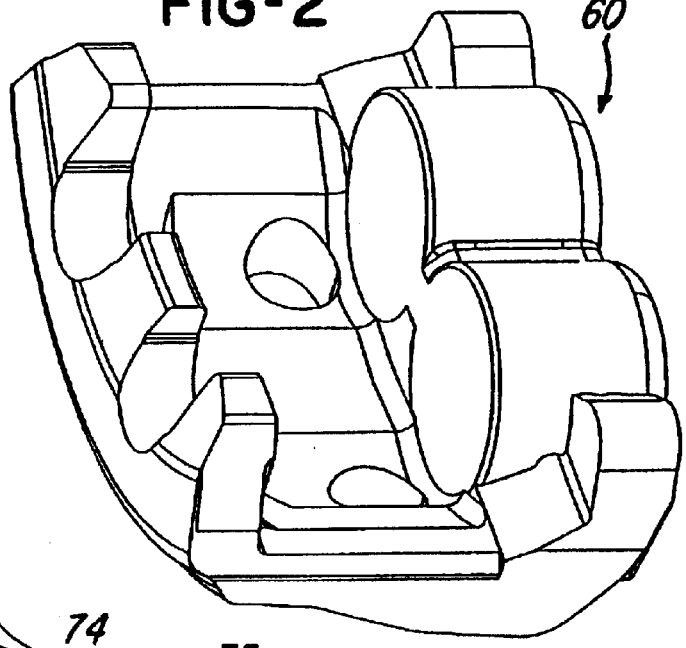
FIG. 2 is a perspective view of a die cast part or aluminum brake caliper housing produced with the press and die members shown in FIG. 1.

In accordance with the present invention, a die set 45 is positioned above the shot sleeve 15 and shot piston 18 and includes an upper die member 48 which is supported for vertical movement by the piston rod of a double acting hydraulic clamping cylinder (not shown), as disclosed in the above '026 and '223 patents. The die set 45 also includes a lower gate plate or die member 52 which may be supported for lateral or horizontal movement by a double acting fluid or air cylinder between a metal injecting position, shown in FIG. 1, and a retracted position (not shown), as also disclosed in above '026 patent. The upper die member 48 and lower die member 52 cooperate to define a die cavity 55 in which is positioned an arcuate fiber reinforcing preform 58. The die cavity 55 has the configuration for producing a C-shaped cast aluminum brake caliper housing 60 (FIG. 2) including the preform 58 (FIG. 3), which will be described later.

The lower die member 52 defines a gate opening 62 which connects the cavity 55 to the shot chamber, and the opening tapers outwardly towards the cavity 55. The inlet of the gate opening 62 is located in the center portion of the shot chamber and has a width or diameter A which is substantially smaller than the diameter B of the inside surface of the shot sleeve 15. Preferably, the area of the gate opening 62 is no greater than 15% of the area of the shot sleeve 15 and shot piston 18. Also, the width or diameter A of the gate opening is preferably less than one third the diameter B. The gate plate or lower die member 52 also defines an annular metal entrapment cavity or recess 65 which extends upwardly into the lower die member from the inner cylindrical surface of the the shot sleeve 15. A series of eight circumferentially spaced and radially extending vent passages or slots 68 are formed within the bottom surface of the lower die member 52 and extend radially outwardly in a spoke-like manner from the metal entrapment recess 65. Each of the vent slots 68 has a depth of about 0.015 inch which is about three times the normal depth of a conventional vent passage commonly located at the parting line or interface between the upper and lower die members.

Figure 3:
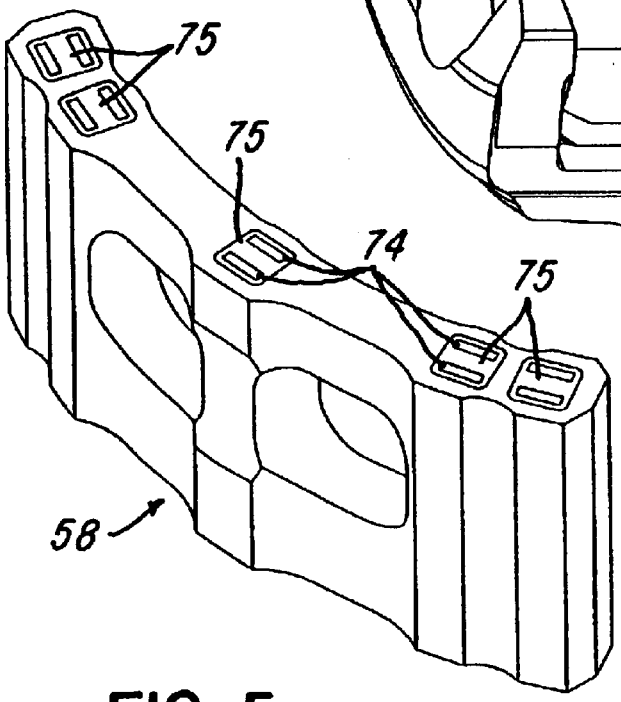
FIG. 3 is a perspective view of a porous preform with chopped fibers and used in die casting the brake caliper housing shown in FIG. 2.
Figure 4:
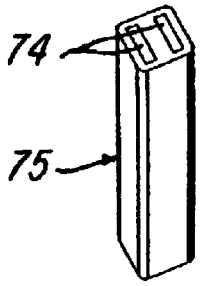
FIG. 4 is a perspective view of a preform insert having continuous reinforcing fibers and used in the preform shown in FIG. 3.
Figure 5:
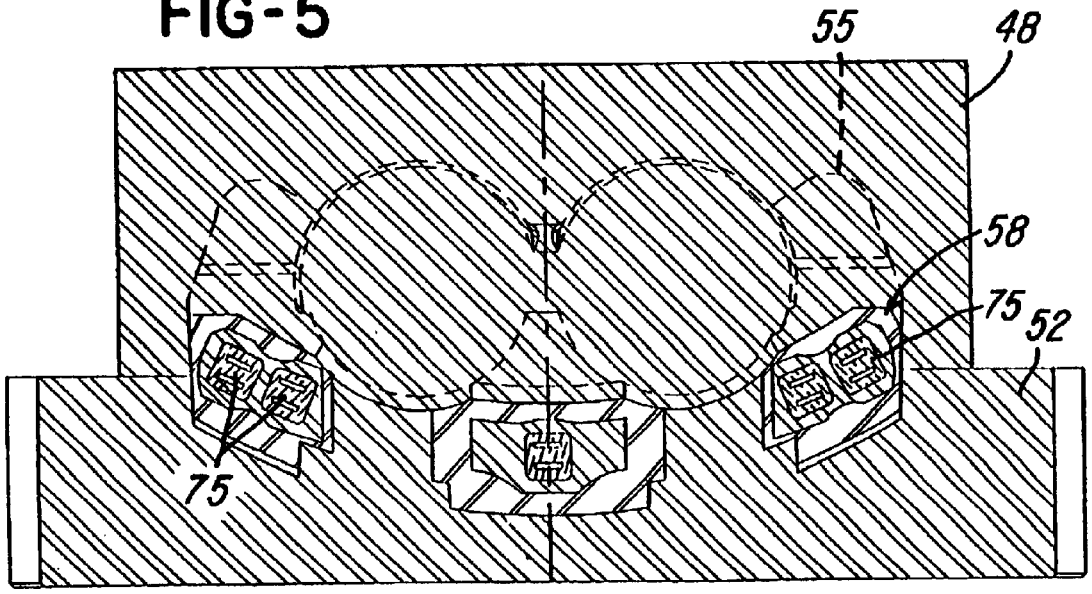
FIG. 5 is a vertical section of the upper and lower die members and preform, taken generally on the line 5—5 of FIG. 1.

Referring to FIGS. 3–5, the arcuate preform 58 is molded of a porous body of chopped fibers, such as fibers of alumina or aluminum oxide or silicon carbide or ceramic fibers within a binder so that the chopped fibers represent about 20% of the preform by volume. NEXTEL fibers, produced by the 3M company, have performed satisfactorily. The preform 58 also has continuous reinforcing fibers such as alumina fibers forming ribbons 74 within an elongated preform insert 75 of the same porous chopped alumina fiber material as used to form the preform 58, but with the continuous fibers representing about 60% of the insert by volume. The preform inserts 75 extend within the preform 58 where higher structural strength and stiffness is required in the C-shaped caliper housing 60. The porous preform 58 and preform insert 75 are made by pouring or inserting a liquid slurry of the chopped reinforcing fibers and a binder within corresponding molds having the shapes of the preform 58 and preform inserts 75. As shown in FIG. 5, the preform 58 is positioned within the die cavity 55 when the upper die member is retracted upwardly and provides for significantly increasing the tensile strength and stiffness of the aluminum brake caliper housing 60 when formed with the press apparatus described above in connection with FIG. 1.

In operation of the vertical die casting press shown in FIG. 1, after the reinforcing preform 58 is placed within the die cavity 55 and the upper die member 48 is shifted downwardly to a position on top of the lower die member 52, as shown in FIGS. 1 and 5, a molten metal or aluminum is inserted or poured into the shot cavity defined by the shot sleeve 15 and shot piston 18. The shot sleeve 15 and molten aluminum are then indexed or shifted laterally to a position under the die set 45 as shown in FIG. 1, and the upper die shoe 48 is clamped to the lower die shoe 52 by the hydraulic clamping cylinder. The shot piston 18 is then moved slowly upwardly by the piston rod 24 of the hydraulic shot cylinder, and the molten metal or aluminum within the center portion of the shot cavity is forced upwardly through the gate opening 62 and into the die cavity 55. The non-tubulant flow of molten metal infiltrates the preform 58 and the inserts 75 within the preform 58 and completely fills the cavity 55.

Due to the water cooled shot sleeve 15 and the water cooled shot piston 18, a "can" of pre-solidified metal forms adjacent the shot sleeve and the shot piston as generally indicated by the dotted line 80. The can includes a cylindrical shell 82 of pre-solidified metal which collapses along the inner cylindrical surface of the shot sleeve 15, and the upper end portion of the collapsing shell 82 is captured in the annular entrapment recess 65 so that the pre-solidified metal does not flow radially inwardly into the gate opening 62 and into the cavity 55. Thus only the highest quality molten metal within the center portion of the shot chamber fills the die cavity 55 and infiltrates the fiber reinforcing preform 58. The small area of the gate opening 62 relative to the area of the shot sleeve 15 with the spacing C being at least equal to the width A of the gate opening 62, also cooperates to prevent pre-solidified metal from entering the gate opening 62.

By eliminating any pre-solidified metal particles within the molten metal flowing into the die cavity 55, the preform 58 and preform inserts 75 are uniformly and effectively infiltrated by the molten metal so that the cast aluminum part or brake caliper housing 60 has a high strength/weight ratio with the infiltrated preform 58 providing the high tensile strength and high stiffness where required in the caliper housing 60. As mentioned above, when the molten metal is moving upwardly with the shot piston 18 within the shot sleeve 15, the air displaced within the shot chamber is free to flow outwardly through the vent slots 68. These vent slots are then closed by the upper end portion of the pre-solidified metal cylindrical shell 82 so that none of the molten metal enters the vent slots 68.

While the use of a press structure as shown in FIG. 1 results in a relative slower injection or fill time, such as three seconds, of the molten metal from the center portion of the shot chamber into the die cavity and also results in a larger biscuit 80 of solidified metal remaining on the shot piston 18 after the cavity is filled, the press and die structure produces a significantly higher quality fiber reinforced die cast part such as the aluminum brake caliper housing 60 which has sufficient strength and stiffness to replace the conventional cast iron brake caliper housing. After the molten metal has substantially solidified within the die cavity 55 and the metal forming the biscuit 80 has partially solidified, the shot piston 18 is moved downwardly so that the biscuit 80 severs from the partially solidified metal within the gate opening 62 at the bottom of the lower die member 52. The operations for removing the die cast part 60 from the die cavity 55 and for removing the biscuit 80 from the shot piston 18 are performed in the same manner as disclosed in the above mentioned '223 patent.

Figure 6:
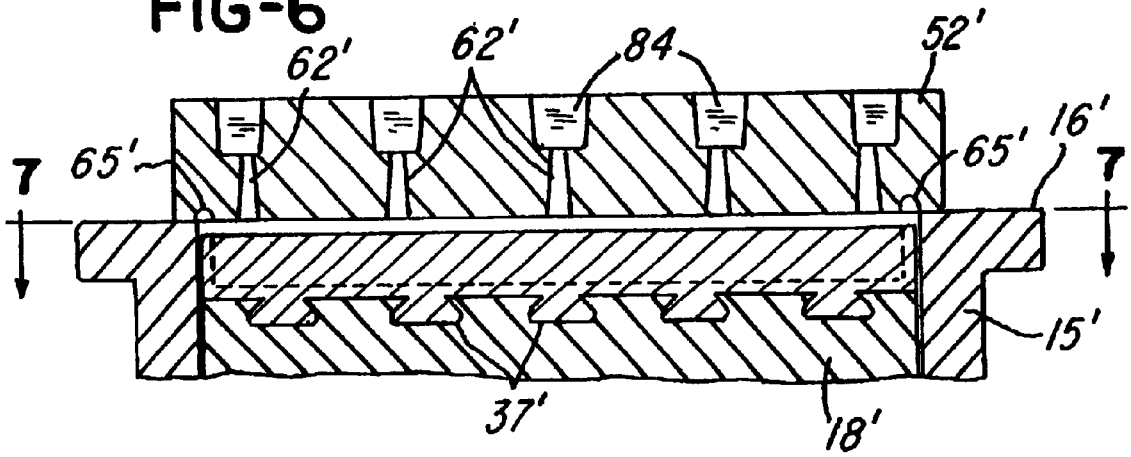
FIG. 6 is a section similar to FIG. 1 and showing another embodiment of the invention.
Figure 7:
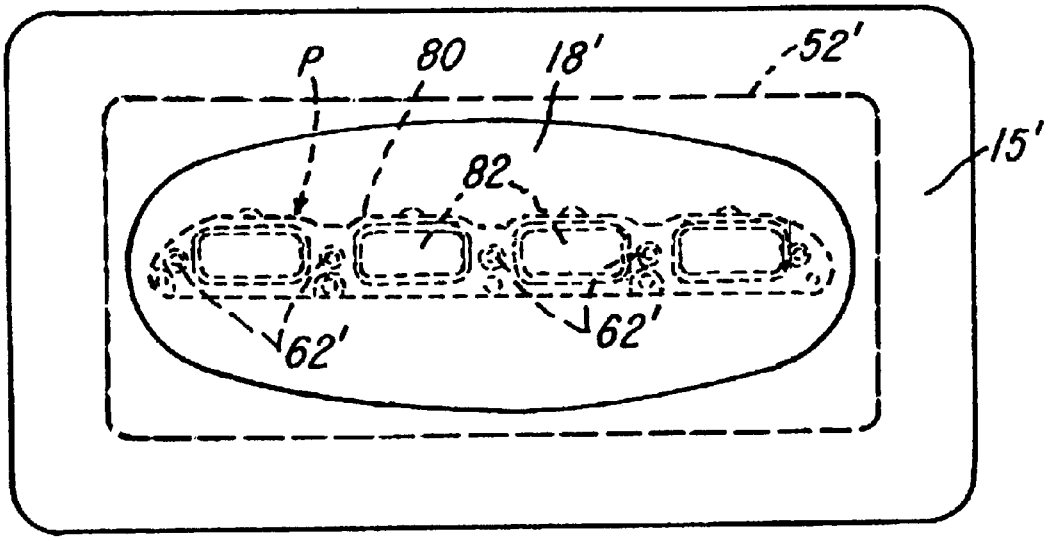
FIG. 7 is a section taken generally along the line 7—7 of FIG. 6.

Referring to FIGS. 6 & 7 which show another embodiment or modification of the invention, a non-circular or oval shot sleeve 15' has an upper mounting flange 16' and defines a non-circular or oval shaped shot chamber which receives a vertically moveable non-circular or oval shot piston 18' which mounts on the piston rod 21. The shot piston 18' and shot chamber are covered by a lower die member 52' which receives an upper die member (not shown) to define an elongated cavity for producing an elongated die cast metal part P, for example, an automotive engine manifold 80 having a plurality of longitudinally spaced passages or openings 82. The lower die member 52' defines a plurality of longitudinally spaced tapered gate openings 62' which are located within the longitudinal center portion of the oval shot chamber, as shown in FIG. 7. The gate openings 62 extend upwardly to corresponding slot-like cavities 84 which forms ribs within the manifold 80 for connecting the walls defining the openings 82. It is to be understood that the die cast metal part P may be any form of die cast part and that the manifold 80 is only illustrated as a typical elongated part. As also shown in FIG. 6, the lower die member 52' defines an annular metal entrapment cavity or recess 65' which conforms to the non-circular or oval shape of the shot chamber and shot piston 18'. The recess 65' functions in the same manner as the cavity or recess 65 described above in connection with FIG. 1.

As shown in FIG. 6, the top surface of the shot piston 18' has a plurality of parallel spaced and tapered dove-tail slots 37' which provide for ejecting the solidified residue biscuit remaining after the molten metal is forced upwardly through the gate openings 62' into the die cavity or cavities. As illustrated by the dotted line in FIG. 6, a shell or "can" of pre-solidified metal forms adjacent the shot sleeve 15' and across the top of the shot piston 18', and the upper end portion of the collapsing shell or can is captured in the annular recess 65' when the shot piston is raised so that the pre-solidified metal does not flow radially inwardly into the gate openings 62' and into the die cavity and contaminate the molten metal within the center portion of the shot chamber.

The elongated non-circular shot sleeve and piston are ideally suited for producing a die-cast part having a length to width ratio greater than two in order to minimize the weight and volume of solidified metal forming the residue biscuit. The non-circular or elongated shot sleeve and piston also provide for a maximum liquid metal pressure for a given upward shot force on the shot piston from the hydraulic piston rod 24. Thus the non-circular or elongated shot sleeve and piston provide for producing elongated parts more efficiently or more practically.

While the methods and forms of press apparatus herein described constitute a preferred embodiment of the invention, it is to be understood that the invention is not limited to the precise methods and forms of apparatus described, and that changes may be made therein without departing from the scope and spirit of the invention as defined in the appended claims.

What is claimed is:

1. A vertical die casting press for producing a die cast metal part, said press comprising a non-cylindrical shot sleeve defining a non-cylindrical shot chamber for receiving molten metal and having a generally vertical axis, a non-cylindrical shot piston within said shot sleeve and supported for generally vertical axial movement, said non-cylindrical shot chamber and said non-cylindrical shot piston having substantially the same cross-sectional configuration, and a lower die member above said shot sleeve and defining at least one gate opening for receiving the molten metal forced upwardly by said shot piston.

2. A press as defined in claim 1 wherein said lower die member defines an annular entrapment recess adjacent said shot sleeve for entrapping a shell of pre-solidified metal adjacent said shot sleeve and to prevent pre-solidified metal particles from flowing inwardly and entering said gate opening.

3. A press as defined in claim 1 wherein said shot chamber and said shot piston are oval in cross-sectional configuration.

4. A press as defined in claim 1 wherein said shot chamber and said shot piston have a length substantially greater than their width in horizontal cross-section.

5. A press as defined in claim 4 wherein said lower die member has a plurality of said gate opening spaced along said length of said shot chamber.

6. A method of die casting a fiber reinforced metal part having no significant solid metal particles or porosity, comprising the steps of forming upper and lower die members defining a cavity corresponding to the shape of the part, defining at least one gate opening within the lower die member and extending from a non-cylindrical shot chamber defined by a non-cylindrical shot sleeve and a non-cylindrical shot piston within the sleeve, inserting a porous preform having reinforcing fibers within the cavity, inserting molten metal into the shot chamber, and moving the shot piston upwardly to force the molten metal within the shot chamber upwardly through the gate opening and into the die cavity to infiltrate the preform and fill the die cavity.

7. A method as defined in claim 6 and including the step of forming an annular entrapment recess within the lower die member at the upper end of the shot sleeve, and capturing a shell of pre-solidified metal adjacent the shot sleeve within the entrapment recess to prevent the pre-solidified metal from flowing radially inwardly and entering the gate opening extending from the shot chamber.

8. A method as defined in claim 7 and including the step of venting air from the entrapment recess through vent slots extending laterally outwardly within said lower die member to minimize the flow of air into the die cavity.

* * * * *